US005327738A

United States Patent [19]

Morioka et al.

[11] Patent Number: 5,327,738

[45] Date of Patent: Jul. 12, 1994

[54] METHOD OF FORMING AND MAINTAINING ARTIFICIAL SNOW LAYER

[75] Inventors: Koji Morioka; Ko Kasahara, both of Osaka, Japan

[73] Assignee: Taikisha Ltd., Tokyo, Japan

[21] Appl. No.: 78,008

[22] Filed: Jun. 16, 1993

Related U.S. Application Data

[62] Division of Ser. No. 867,033, Apr. 10, 1992, Pat. No. 5,241,830.

[30] Foreign Application Priority Data

Apr. 11, 1991 [JP] Japan ..... 3-78779
May 27, 1991 [JP] Japan ..... 3-120738

[51] Int. Cl.[5] ..... F25C 1/12

[52] U.S. Cl. ..... 62/74; 62/92; 472/90

[58] Field of Search ..... 472/90; 62/91, 92, 140, 62/235, 309, 340, 74

[56] References Cited

U.S. PATENT DOCUMENTS 2,676,471 4/1954 Pierce, Jr. ..... 472/90 X
3,405,534 10/1968 Sullivan ..... 62/239 X
4,351,157 9/1982 Zeigler ..... 62/340 X
4,914,923 4/1990 Duplan et al. ..... 472/90 X
5,018,360 5/1991 Jones ..... 62/340 X
5,062,279 11/1991 Kawashima et al. ..... 62/235

FOREIGN PATENT DOCUMENTS 4-36563 2/1992 Japan ..... 62/235
WO89/12793 12/1989 PCT Int'l Appl. .

*Primary Examiner*—William E. Tapolcai
*Attorney, Agent, or Firm*—Webb, Ziesenheim, Bruening, Logsdon, Orkin & Hanson

[57] ABSTRACT

A method of forming an artificial snow layer is disclosed. Water content is added to to atmosphere above a floor by a humidifying device, or water mist is added to the atmosphere by a water-mist supplying device. The water content or the water mist is frost-frozen by a refrigerating device 6 incorporated at the floor, thus forming on the floor an accumulated frost layer as an artificial snow layer. A method of maintaining the formed artificial snow layer is also disclosed. After the formation of the artificial snow layer, an atmosphere refrigerating device is stopped or reduced in its operation so as to release the maintenance of the atmosphere below the freezing point. Then, the refrigerating device of the floor is operated to prevent melting of the formed artificial snow layer so as to prevent coagulation of water content in said atmosphere on a surface of the artificial snow layer through humidity adjustment of the atmosphere by a humidity adjusting device.

3 Claims, 3 Drawing Sheets

METHOD OF FORMING AND MAINTAINING ARTIFICIAL SNOW LAYER

This is a divisional of copending application(s) Ser. No. 07/867,033 filed on Apr. 10, 1992, now U.S. Pat. No. 5,241,830.

BACKGROUND OF THE INVENTION

1. Field of the Invention

The present invention relates to a method of forming and maintaining an artificial snow layer, and more particularly a method of forming and maintaining an artificial snow layer at e.g. an artificial snow indoor skiing slope.

2. Description of the Related Art

Conventional methods of forming an artificial snow layer will be described. According to a first conventional method, indoor atmosphere present immediately above a floor surface is refrigerated to e.g. a low temperature ranging between −6 and −10 degrees in Celsius and then cold water is sprayed through a spraying nozzle onto the floor with compressed air. With this, through the adiabatic expansion effect associated with the nozzle spraying and the refrigeration of the indoor air, the sprayed water is frozen into Fine ice particles. Then, as the ice particles are accumulated on and spread over the floor, an artificial snow layer comprised of ice particles is formed on the floor surface.

According to a second conventional method, water-absorbent resin particles containing water are sprayed over a floor surface and the layer of the sprayed water-containing resin particles is frozen there by means of a refrigerating means incorporated at the floor. Then, this frozen layer is pulverized into fine particles by a pulverizing machine, thereby to form on the floor surface an artificial snow layer comprising the layer of frozen water-absorbent resin particles. This method is described, for instance, in the PCT/AU85/00267.

However, according to the first conventional method, an enormous amount of energy is required for maintaining the indoor atmosphere (the atmosphere can be huge in volume in case of e.g. the indoor skiing slope) at such low temperature ranging between −6 and −10 degrees in Celsius regardless of the outdoor temperature. The amount of energy required will be significant in the summer season. Therefore, this method suffers the problem of significant cost for the formation of the artificial snow layer. Moreover, the maintenance costs will also be significant for maintaining the indoor atmosphere at the low temperature of −2 to −3 degrees in Celsius by preventing the snow layer from being melted.

In addition, since the indoor atmosphere is maintained at such low temperature as described above during the snow-layer forming operation and also during the actual use of the formed snow layer, the user of the slope, i.e. a skier, or a worker tends to feel uncomfortably cold or even feel dizzy due to a thermal shock from the drastic change in the temperature between the extremely low indoor atmosphere and the warm or hot (may exceed 30 degrees in Celsius in summer) outdoor atmosphere when he/she comes in and out of the construction. Thus, this method may cause the problems of health hazard and discomfort for the users and workers as well.

On the other hand, according to the second conventional method, the artificial snow layer consists of a great number of water-absorbent resin particles. Then, although the layer is pulverized into fine particles, the layer consisting of the pulverized particles still gives a considerably different skiing feel to the users than they get from natural snow.

SUMMARY OF THE INVENTION

Taking the above-described state of the art into consideration, a primary object of the present invention is to provide an improved method of forming and maintaining an artificial snow layer which can form the snow layer in an efficient manner and without the afore-described problems of the prior art.

For accomplishing this object, according to a method of the present invention, water content added by a humidifier to atmosphere present immediately above a floor surface or water mist fed to the atmosphere by a water-mist feeder is frost-frozen to form on the floor surface an artificial snow layer comprised of a layer of frozen frost.

Functions and effects of this method will be described next.

The water-content or the water-mist added (preferably very fine water particles in the form of mist having a particle diameter ranging below 10 μm) to the atmosphere present immediately above the floor surface can be frost-frozen on the site without being directly influenced by the temperature of the atmosphere if a temperature at the site on the floor goes down below a value low enough to allow frost-freezing.

Accordingly, when the water content or the water mist in the atmosphere is frost-frozen by means of a refrigerating means incorporated at the floor to form a layer of artificial snow, the method of the invention, unlike the afore-described first conventional method, can eliminate the necessity of maintaining the atmosphere at such significantly low temperature ranging between −6 and −10 degrees in Celsius.

Further, since only the floor surface where the snow layer is to be formed is refrigerated in a concentrated manner by means of the refrigerating means incorporated at the floor, the method allows significant reduction in the refrigerating load in comparison with the first conventional method where the entire indoor atmosphere present above the floor surface must be maintained at the refrigerating temperature against the outdoor atmosphere condition.

In addition, the method of the invention basically requires only water or water mist to be added to the atmosphere for forming the artificial snow layer, in contrast to the second conventional method which requires a great volume of water-absorbent resin particles.

Moreover, the frozen-frost layer formed by the frost-freezing of the water content or water mist added to the atmosphere consist of fine frost crystals having fine gaps between the adjacent crystals like natural snow. Accordingly, this layer can give a comfortable skiing feel very similar to that given by natural snow. Also, unlike the second conventional method, there arises no necessity of pulverizing the frozen layer by using a large amount of energy.

When there arises a necessity of compressing or crushing the frost layer in order to appropriately condition the snow surface to suit a particular purpose, the method of the present invention requires much less energy and/or labor force for this work in comparison with the second conventional method requiring the pulverization of the frozen layer on the floor surface.

Consequently, the method of the present invention can significantly reduce the energy for the refrigeration and can also eliminate the necessities of any special material such as the water-absorbent resin particles and of the pulverizing operation using a large amount of energy. So that, in contrast to the conventional methods, the method can achieve a significant reduction in the entire costs for forming an artificial snow layer as well as improvement of quality of the snow surface to produce a snow texture quite similar to that of natural snow.

Further, in the respect of the maintenance of the artificial snow layer, as in the above case of the snow layer formation, the method can maintain the formed artificial snow layer by preventing melting of the snow layer by the refrigerating means incorporated at the floor. Thus, unlike the first conventional method, the method of the present invention can solve the problems that the user or the worker may feel uncomfortably cold because of the maintenance of the atmosphere adjacent the floor surface at the extremely low temperature and that he/she may feel a thermal shock due to the significant temperature difference between the low-temperature indoor atmosphere and the high-temperature outdoor atmosphere. So that, the method of the invention is superior in the respects of health and comfort of the worker and the user.

Incidentally, as an alternative method, it is conceivable to effect, by means of a refrigerating machine, the frost-freezing operation of the water content or the water mist in the atmosphere at a site different from the one where a snow layer is to be formed. Then, this frost will be collected and transported to the object site to be sprinkled over its surface thereby forming an artificial snow layer on the surface. This alternative method, however, has the disadvantage of cost and labor increase for the collection and transportation of the frost.

In this respect too, according to the method of the present invention, the frost-freezing operation of the water content or the water mist added to the atmosphere is effected by means of the refrigerating means incorporated at the floor which per is the site where the snow layer is to be formed and through this frost-freezing process the accumulated frost layer as an artificial snow layer is developed and formed on the floor surface. That is, the method of the present invention can eliminate the collection and the transportation of the frost, thereby achieving reduction in the cost and labor associated with the formation of the artificial snow layer.

According to one preferred embodiment of the present invention, prior to the formation of the accumulated frost layer, fine ice particles are sprinkled over the floor surface. Then, this layer of sprinkled ice particles is impregnated with additional water, so that the additional water content is then frozen by means of the above-described refrigerating means. Thereafter, on the ice layer containing the frozen water content, the water content or the water mist added to the atmosphere above the layer is frost-frozen to form an artificial snow surface on the ice layer.

That is, for stable maintenance of the artificial snow surface against possible variation in the thermal load or actual use of the snow surface, it is necessary to retain a certain amount of cold heat on the floor surface by e.g. appropriately enlarging thickness of the accumulated frost layer or by providing, under the frost layer, an ice layer having a certain thickness. However, it takes a significant amount of time to develop the frost layer, through repeated frost-freezing operations, up to such a thickness as to allow the frost layer alone to retain such capacity of cold heat on the floor surface without the aid of the ice layer. On the other hand, in the case of forming an ice layer of sufficient thickness for the retention of desired capacity of cold heat under the accumulated frost layer as the artificial snow layer, it also takes a large amount of time to sprinkle water onto the floor surface and then to freeze the sprinkled water by the refrigerating means of the floor in order to form an ice layer of the predetermined thickness on the floor surface.

In this respect, according to the method of the invention also, an ice layer is formed under an accumulated frost layer as an artificial snow layer. Yet, in the formation of the ice layer, the ice layer in the form of fine particles is formed by sprinkling fine ice particles onto the floor surface and the water added to the layer of the fine ice particles is frozen by the refrigerating means of the floor. That is, only the water added to the fine ice particle layer is frozen by means of the refrigerating means prior to the formation of the accumulated frost layer. Therefore, in comparison with the foregoing method where water is sprinkled onto the floor surface and this sprinkled water is frozen by means of the refrigerating means of the floor to form an ice layer of a predetermined thickness, with the above-described method, it is possible to form an ice layer of a predetermined thickness needed for retain a predetermined cold heat capacity on the floor surface within a short period of time.

As described above, according to the method of the invention, the ice layer is efficiently formed by freezing the water added to the fine ice particle layer and then the water content or the water mist added to the atmosphere is frost-frozen on this ice layer by the refrigerating means to form an accumulated frost layer as an artificial snow layer. Therefore, in comparison also with the method where the accumulated frost layer having a thickness sufficient to retain a desired cold heat capacity is developed only through the gradual frost-freezing of the water content or the water mist added to the atmosphere without the formation of the ice layer under the accumulated frost layer, with the method of the invention, it is possible to form an artificial snow layer comprised of an accumulated frost layer capable of retaining a desired cold heat capacity on the floor surface in an efficient manner and within a short period of time.

Further, as an alternative in embodying the method of the present invention, in the course of development of the accumulated frost layer, the accumulated frost layer will be compressed and this compressed layer will be impregnated with additional water content. Then, this water content will be frozen, and on this frozen frost layer the water content or the water mist added to the atmosphere will be frost-frozen to form the accumulated frost layer.

As a further alternative in embodying the method of the present invention, in the course of the development of the accumulated frost layer, the accumulated frost layer will be impregnated with additional water content, so that this water content will be frozen and on this frozen layer the water or the water mist added to the atmosphere will be frost-frozen to develop the accumulated frost layer.

That is, since the accumulated frost layer has fine gaps between the frost crystals, the layer per se has a heat insulating effect. Therefore, if the water content or the water mist added to the atmosphere is gradually frost-frozen on the layer surface through the refrigerating effect of the refrigerating means of the floor, with the increase in the thickness of the accumulated frost layer as being developed, there occurs significant reduction in the heat transmission efficiency between the refrigerating means of the floor and the surface of the accumulated frost layer. So that, with the development of the accumulated frost layer up to a certain thickness, it becomes impossible to further increase the thickness of the accumulated frost layer as the artificial snow layer through the continuous development of the accumulated frost layer through the frost-freezing on the frost layer.

Moreover, in order to further increase the thickness of the accumulated frost layer through the continuation of the frost-freezing operation on the frost layer to cope with the reduction in the heat transmission efficiency between the refrigerating means of the floor and the surface of the accumulated frost layer, it becomes necessary to further reduce the temperature provided by the refrigerating means of the floor. Then, this reduction in the temperature will cause deterioration in the operational efficiency and increase in the loss of radiated cold heat on the side of the refrigerating means.

To solve the above problem, according to the features of the present invention, the compression treatment is effected on the accumulated frost layer in the course of the development of this layer and this layer is impregnated with the additional water content. With this, the accumulated frost layer becomes somewhat similar to an ice layer so as to restore the heat transmission efficiency of the accumulated frost layer. Accordingly, while the refrigerating temperature of the refrigerating means of the floor is maintained constant, the frost-freezing operation on the accumulated frost layer by the refrigerating effect of this refrigerating means can be promoted thereby to continue the further development of the accumulated frost layer in an efficient manner. Consequently, the thickness of the accumulated frost layer as an artificial snow layer can be increased very efficiently.

In embodying the method of the present invention, it is conceivable to cover the space above the floor surface so as to limit the atmosphere to which the water content and the water mist is to be added.

With the above arrangement, in case the atmosphere area on the floor surface comprises an open atmosphere or even an indoor atmosphere area, as in the formation process of the artificial snow layer this atmosphere area above the floor surface is covered to limit the extension of the atmosphere area to which the water content or the water mist is added, it becomes easier to increase the density of the water content or the water mist in the atmosphere on the floor surface lip to a value suitable for the formation of the accumulated frost layer through the frost-freezing operation and to maintain the density as such. As a result, the formation operation of the accumulated frost layer through the frost-freezing process can be conducted more efficiently.

Further, according to a method of the present invention for maintaining an artificial snow layer, the method comprises the steps of:

maintaining atmosphere above a floor surface below a freezing point by an atmosphere refrigerating means;

forming an artificial snow layer by accumulating on the floor surface ice particles frozen through spraying of water into said atmosphere;

stopping or reducing the work of the atmosphere refrigerating means after the formation of the artificial snow layer so as to release the maintenance of the atmosphere below the freezing point;

operating a further refrigerating means incorporated at the floor to prevent melting of the formed artificial snow layer; and preventing coagulation of water content in said atmosphere on a surface of said artificial snow layer through humidity adjustment of said atmosphere by a humidity adjusting means.

Functions and effects of the above features of the present invention will be described next.

During the formation of an artificial snow layer, the water is frozen into ice particles through spraying of the water into the atmosphere maintained below a freezing point and the snow layer is formed by accumulation of the ice particles. Accordingly, there is no need for any treatment requiring a large power such as cutting and crushing of a frozen layer. Further, for additional formation of snow layer, no such treatment as formation of new frozen layer or cutting and crushing of this new layer is necessary. Thus, the formation of additional layer to the remaining snow layer can be done easily and efficiently within a short period of time.

Moreover, after the formation of the artificial snow layer, the atmosphere refrigerating means is stopped or reduced in its work so as to release the maintenance of the atmosphere below the freezing point. Instead, a further refrigerating means incorporated at the floor is operated to refrigerate the snow layer in a direct and concentrated manner so as to prevent melting of the formed artificial snow layer. Thus, as compared with the case where for prevention of the melting of the snow layer the area atmosphere is continuously maintained below the freezing point after the formation of the snow layer, it is possible to significantly reduce the energy required for the refrigeration for the purpose of maintenance of the snow layer. Further, since the refrigerating means incorporated at the floor is used for the refrigeration of the snow layer, it is possible to effectively prevent the user of the artificial snow layer within the area from feeling uncomfortably cold or massive thermal shock during entrance to or exit from the area.

Further, since coagulation of water content in the atmosphere on a surface of the artificial snow layer is prevented through humidity adjustment of the atmosphere by a humidity adjusting means, it is possible to avoid deterioration of the snow surface condition such as sticky condition of the snow surface resulting from such coagulation. Also, for the avoidance of such sticky snow surface condition, the method does not require any special treatment such as excessive reduction in the refrigerating temperature provided by the snow layer refrigerating means.

As the results of the above, according to the method of the invention of maintaining an artificial snow layer, the artificial snow layer can be formed easily and at low costs without necessitating a large power. The further formation of additional snow layer, which is done for adding a new snow layer to the remaining old snow layer for compensating for e.g. decrease in the snow layer thickness, also can be effected within a short period of time, so that it is possible to reduce an idle time period when the snow layer is unusable fop addition of a new snow layer. Further, the maintenance of the snow layer can be effected with reduced running costs and the reduction in the snow layer thickness can be effectively restricted, so that required frequency of the operation for forming additional snow layer per se can be reduced.

Moreover, the method can provide the users, e.g. skiers with improvement in the comfort and hygiene respects as well as maintenance of the snow surface at a very good condition.

For achieving the functions and effects described above, as an alternative to the method of maintaining an artificial snow layer according to the present invention, the following method is conceivable. Namely, according to this alternative method, a snow manufacturing room is provided separately from the floor area where a snow layer is to be formed, and in this room water is sprayed with the indoor atmosphere of the room being maintained below a freezing point thereby to produce artificial snow. On the other hand, the floor area where the artificial snow layer is to be formed is not refrigerated to a temperature below the freezing point during formation of the snow layer. Instead, the artificial snow produced in the snow manufacturing room is transported to and accumulated on the floor area. Then, the snow layer refrigerating means incorporated at the floor is operated to prevent melting of the accumulated snow layer while the humidity adjusting means is operated to adjust the humidity of the floor area atmosphere so as to prevent coagulation of the water content in the atmosphere on the snow layer surface.

With this alternative method, however, the snow manufacturing room provided separately from the floor area where the snow layer is to be formed is needed, so that the installment costs and space will inevitably increase. Further, a large amount of labor and power will be needed for the transportation of the artificial snow manufactured in the snow manufacturing room to the object floor area. In this respect, according to the foregoing method of the present invention, the floor area per se where the snow layer is to be formed is utilized also as a place for manufacturing the artificial snow. So that, as compared with the above-described alternative method, it is possible to reduce the necessary installment space and costs. Moreover, the method of the present invention has a further advantage of further reducing the snow layer forming costs through the avoidance of the labor and power required for the transportation of the manufactured artificial snow.

Further, and other objects, features and effects of the invention will become more apparent from the following more detailed description of the embodiments of the invention with reference to the accompanying drawings.

DESCRIPTION OF THE PREFERRED EMBODIMENTS

Preferred embodiments of a method of the present invention of forming and maintaining an artificial snow layer will be particularly described next with reference to the accompanying drawings.

Figure 1:
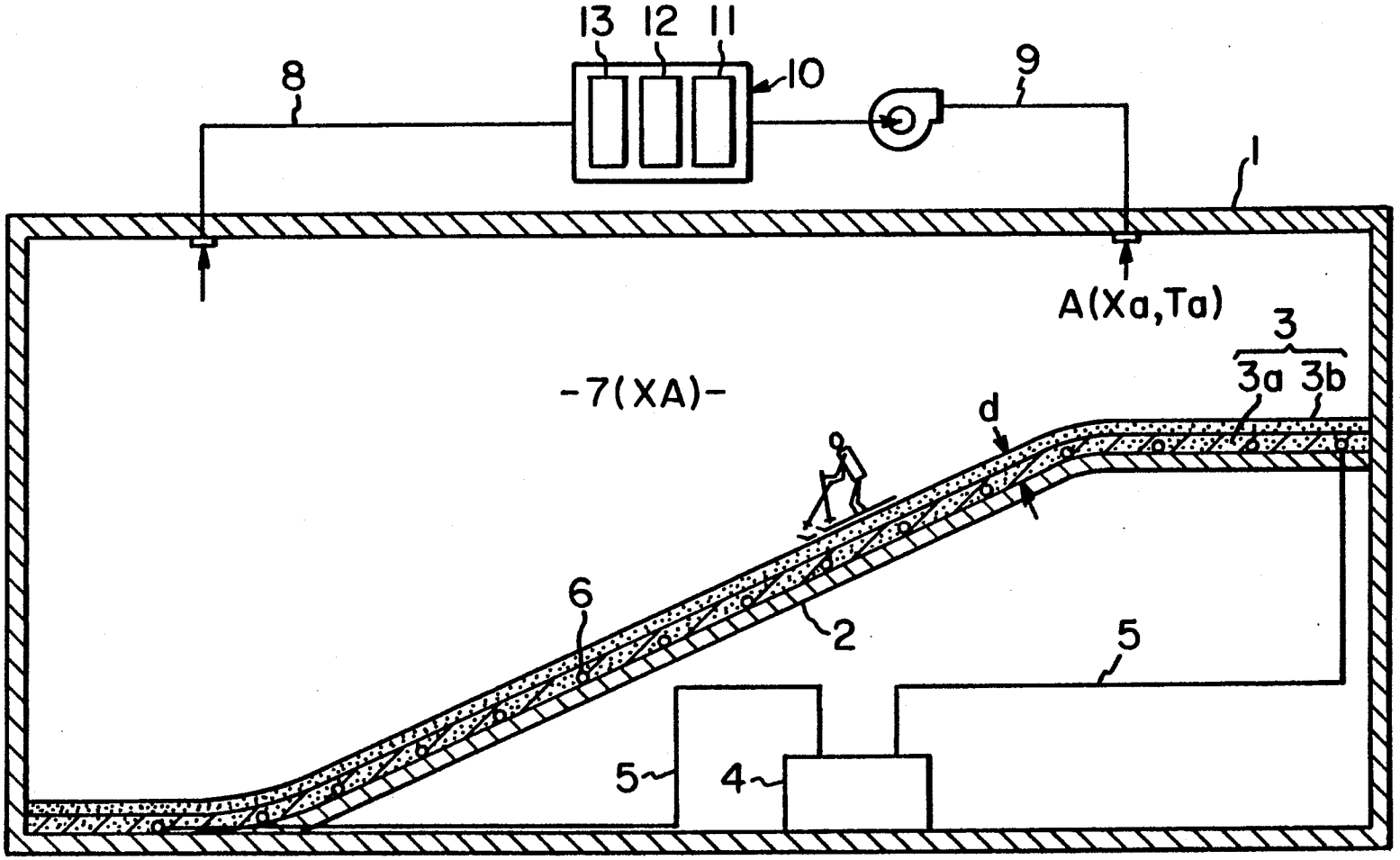
FIG. 1 is a view showing a construction of an indoor artificial snow skiing slope relating to one preferred embodiment of the present invention.

FIG. 1 shows an indoor artificial snow slope, in which a numeral 1 denotes a building construction and a numeral 2 denotes a floor on which an artificial snow layer 3 as a skiing slope is to be formed.

The floor 2 incorporates therein a plurality of refrigerating medium pipes 6 for circulating through a circulating passage 5 a refrigerating medium (e.g. brine at −10 to −20 degrees in Celsius) refrigerated by a refrigerating device 4. Through this refrigeration of the refrigerating medium pipes 6, the artificial snow layer 3 is formed on the floor 2 and also melting of this snow layer 3 is prevented, so that the artificial snow layer 3 is maintained.

As an air-conditioning system for an indoor space 7, an air-conditioning device 10 is provided for conditioning temperature and humidity of the indoor atmosphere recycled through a recycling duct 8 (the indoor atmosphere can be mixed with new fresh outdoor atmosphere) and then feeding this conditioned atmosphere A through a feed duct 9 into the indoor space 7. This air-conditioning device 10 includes a temperature-conditioning coil 11, a dehumidifier 12 and a humidifier 13 with these devices being selectively operable depending on the conditions.

For the formation of the artificial snow layer 3, the refrigerating medium is circulated through the refrigerating-medium circulating pipes 6 and with this operation atmosphere A added with water content by operation of the humidifier 13 is fed into the indoor space 7. With this, the water content added to the atmosphere A fed into the indoor space 7 is frost-frozen through the refrigeration by the refrigerating-medium pipes 6, so that an accumulated frost layer 3 having a predetermined thickness (d) is formed as an artificial snow layer on the floor 2.

In the initial stage of the formation of the accumulated frost layer when the water content in the fed atmosphere A is frost-frozen directly on surfaces of the refrigerating-medium pipes 6, the amount of humidity provided by the humidifier 13 is controlled by an appropriate control device so as to maintain an absolute humidity Xa of the fed atmosphere A higher than an absolute humidity Xp of saturated atmosphere at a pipe surface temperature Tp of the refrigerating medium pipe 6 more than by a predetermined difference $d\times1$ (e.g. $d\times1=5$ gr./Kg'). Thereafter, in the next stage of development of the accumulated frost layer when the water content added to the atmosphere A is frost-frozen, the amount of humidity provided by the humidifier 13 is again controlled by the appropriate control device so as to maintain the absolute humidity Xa of the fed atmosphere A higher than the absolute humidity Xp of saturated atmosphere at the pipe surface temperature Tp of the refrigerating medium pipe 6 more than by a further predetermined difference $d\times2$ (e.g. $d\times2=5$ gr./Kg'). With this, through the initial stage and the development stage, the accumulated frost layer 3 can be maintained and developed in an efficient manner.

As described above, in the formation of the accumulated frost layer 3 on the floor 2 through the frost-freezing of the fed atmosphere A by means of the refrigerating effect of the refrigerating-medium pipes 6 incorporated at the floor 2, a temperature Ta of the fed atmosphere A is not particularly an important factor. However, in the present embodiment, this temperature Ta of the fed atmosphere A is so adjusted as to render a relative humidity Ra of the atmosphere A over 100% in order to further promote the formation of the accumulated frost layer 3 through the frost-freezing operation.

On the other hand, in the adjustment of the temperature Ta of the fed atmosphere A, within the range where the relative humidity Ra is more than 100%, the temperature Ta of the atmosphere A is adjusted to as high a temperature as possible. This can avoid excessive cooling of the indoor space 7 thereby to prevent a user in the construction from feeling uncomfortably cold or a thermal shock due to a significant difference in the temperature between the indoor atmosphere and the outdoor atmosphere (for instance, in the development stage of the accumulated frost layer where the water content added to the atmosphere A is frost-frozen on the surface of the frost layer, if the surface temperature Ts of the accumulated frost layer 3 is −5 degrees in Celsius and the value d×2 is 5 gr./Kg', an over-saturation atmosphere (containing very fine water particles) adjusted approximately to 8.0 degrees in Celsius DB, 7.5 gr./Kg' is supplied).

Figure 2:
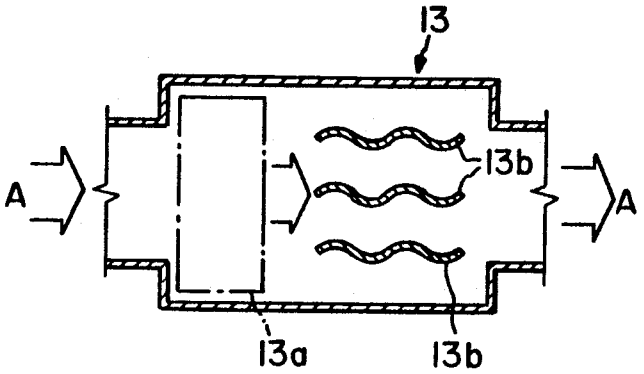
FIG. 2 is a principle diagram of a humidifier.

As the humidifier 13, various types can be used such as a vapor spraying type. Then, in this embodiment, as illustrated in FIG. 2, a so-called washer type humidifier 13 is employed. In operation, the atmosphere A to be adjusted is caused to pass a spraying region 13*a* where water having its temperature adjusted to a temperature equal to the temperature Ta of the atmosphere fed to the indoor space 7 is sprayed, so that the object atmosphere A is adjusted into the over-saturated atmosphere having the predetermined temperature Ta. Thereafter, as this adjusted atmosphere A is cause to pass through a plurality of separator plates 13*b*, water particles of relatively large particle diameters contained in the adjusted atmosphere A are trapped at the separator plates 13*b*. In comparison with the vapor spraying type humidifier, this type of humidifier is advantageous in the respect of thermal energy. Also, the temperature and humidity of the object atmosphere A are adjusted to those of the over-saturated atmosphere mixed with very fine water particles (preferably, ranging below 10 micron) suitable for the formation of the accumulated frost layer through the frost-freezing process described hereinbefore.

In the development stage of the accumulated frost layer 3, when the frost layer has been developed to a certain thickness, a compressing treatment is effected on the thus developed frost layer 3*a*. Alternatively, the accumulated frost layer 3*a* is impregnated with additional water content supplied by sprinkling and the water content is frozen by the refrigerating function of the refrigerating-medium pipes 6, thereby rendering some of the accumulated frost layer 3*a* into an ice layer. Then, as the partial formation of the ice layer restores heat transmission efficiency of the accumulated frost layer 3*a* (i.e. the heat transmission efficiency between the refrigerating-medium pipes 6 and the surface of the accumulated frost layer 3*a*), through the frost-freezing of the water content in the atmosphere on either the compressed frost layer or the frozen frost layer 3*a* added with the water content, the accumulated frost layer 3*b* can be efficiently maintained and developed on the compressed frost layer or the frozen frost layer 3*a* added with the additional water content.

The formation of the partial ice layer from the accumulated frost layer 3*a* through the compression process or the addition of the additional water content is done for a plurality of times with an appropriate time interval therebetween in the process of forming the accumulated frost layer 3 having the predetermined thickness (d) as an artificial snow layer.

With completion of the accumulated frost layer 3 having the predetermined thickness (d) as an artificial snow layer, the operation of the humidifier 13 is stopped. Thereafter, this artificial snow layer is maintained against melting by the refrigerating function of the refrigerating-medium pipes 6. Also, in this maintenance condition of the artificial snow layer, the dehumidifier 12 of the air-conditioning device 10 is operated and also the absolute humidity XA of the atmosphere inside the indoor space 7 is maintained at a value substantially equal to the absolute humidity Xs of the saturated atmosphere at the surface temperature Ts of the accumulated frost layer 3. In other words, the amount of humidity eliminated by the dehumidifier 12 is controlled by an appropriate control means so as to maintain the water vapor pressure of the atmosphere inside the indoor space 7 at a value substantially equal to the water vapor pressure at the surface of the accumulated frost layer 3.

That is to say, during the formation and maintenance of the accumulated frost layer as an artificial snow layer, a refrigerating temperature Tp of the refrigerating-medium pipes 6 is so adjusted to a value sufficient to cause the layer 3 to develop into the predetermined thickness (d) and also to prevent melting of this accumulate frost layer 3 having the predetermined thickness (d) (e.g. a temperature where the surface temperature Ts of the frost layer 3 developed into the thickness of ( d ) ranges between −1 and −2 degrees in Celsius). While this can save the necessary energy, there arises, in turn, a new problem. That is, if the refrigerating temperature Tp of the refrigerating-medium pipes 6 is so controlled, during the maintenance of the artificial snow layer, the surface of this artificial snow layer 3 tends to become sticky. For, further water content supplied into the atmosphere through introduction of outdoor atmosphere or breaths of the users present inside is coagulated on the surface of the accumulated frost layer 3, so that the additional water content may be coagulated on the surface of the accumulate frost layer 3 which temperature is higher than the refrigerating temperature Tp of the refrigerating-medium pipes 6. Moreover, the coagulation of the additional water content in the indoor atmosphere on the surface of the accumulated frost layer 3 causes also transfer of potential heat from the indoor atmosphere to the accumulated frost layer 3. Accordingly, there occurs increase in the refrigerating load of the pipes 6 in maintaining the artificial snow layer and this increase will interfere with the saving of energy.

In this respect, as described hereinbefore, the dehumidifying treatment is effected on the indoor atmosphere in the snow layer maintaining situation thereby to prevent such coagulation of the water content in the atmosphere on the surface of the accumulated frost layer 3 (i.e. snow surface) while controlling the required refrigerating temperature of the refrigerating-medium pipes 6. With this arrangement, it is possible to stably maintain the snow surface at a good condition suitable for skiing and also to achieve saving of energy through effective avoidance of such increase in the refrigerating load of the pipes 6 resulting from the potential heat transfer from the indoor atmosphere to the accumulated frost layer 3.

In the course of maintaining the artificial snow layer, in addition to the above-described dehumidifying operation, a temperature controlling coil 11 of the air-conditioning device 10 is operated to adjust the temperature of the atmosphere A to be fed into the indoor space 7. With this, it is possible to cool or warm the indoor space 7 without sacrificing the comfort of the users such as the skiers and also without interfering with the prevention of melting of the accumulated frost layer 3 by means of the refrigerating function of the refrigerating-medium pipes 6.

In case the thickness of the accumulated frost layer 3 as the artificial snow layer decreases due to scraping of the snow surface by skiing, like the case of the initial formation of the artificial snow layer, the humidifier 13 is operated, so that the additional water content added to the atmosphere A for the indoor space 7 is refrigerated by the refrigerating-medium pipes 6 to be frost-frozen on the remaining frost layer 3 thereby to restore the thickness of the accumulated frost layer 3.

Next, alternate embodiments of the invention will be specifically described.

The refrigerating means to be incorporated at the floor 2 is not limited to the plurality of refrigerating-medium pipes 6 employed in the foregoing embodiment. For instance, other constructions such as a construction having a refrigerating-medium passage at a gap between two floors or a further construction using a plurality of refrigerating panels disposed on the floor 2 can be employed instead.

In the foregoing embodiment., the accumulated frost layer 3 is formed by frost-freezing the water content added to the atmosphere above the floor 2 by means of the refrigerating means 6. Alternatively, water mist can be supplied to the atmosphere above the floor 2 by means of e.g. a spraying nozzle, so that this sprayed water mist will be frost-frozen by means of the refrigerating means 6 incorporated at the floor 2. Further, as a combination of these methods, it is also conceivable to frost-freeze both the water content added to the atmosphere above the floor 2 and the water mist supplied also to this atmosphere above the floor 2 by means of the refrigerating means 6 incorporated at the floor 2.

As the humidifier means for adding water content to the atmosphere above the floor 2 and the water mist supplying means for supplying this atmosphere with water mist, various other types can be employed.

Figure 3:
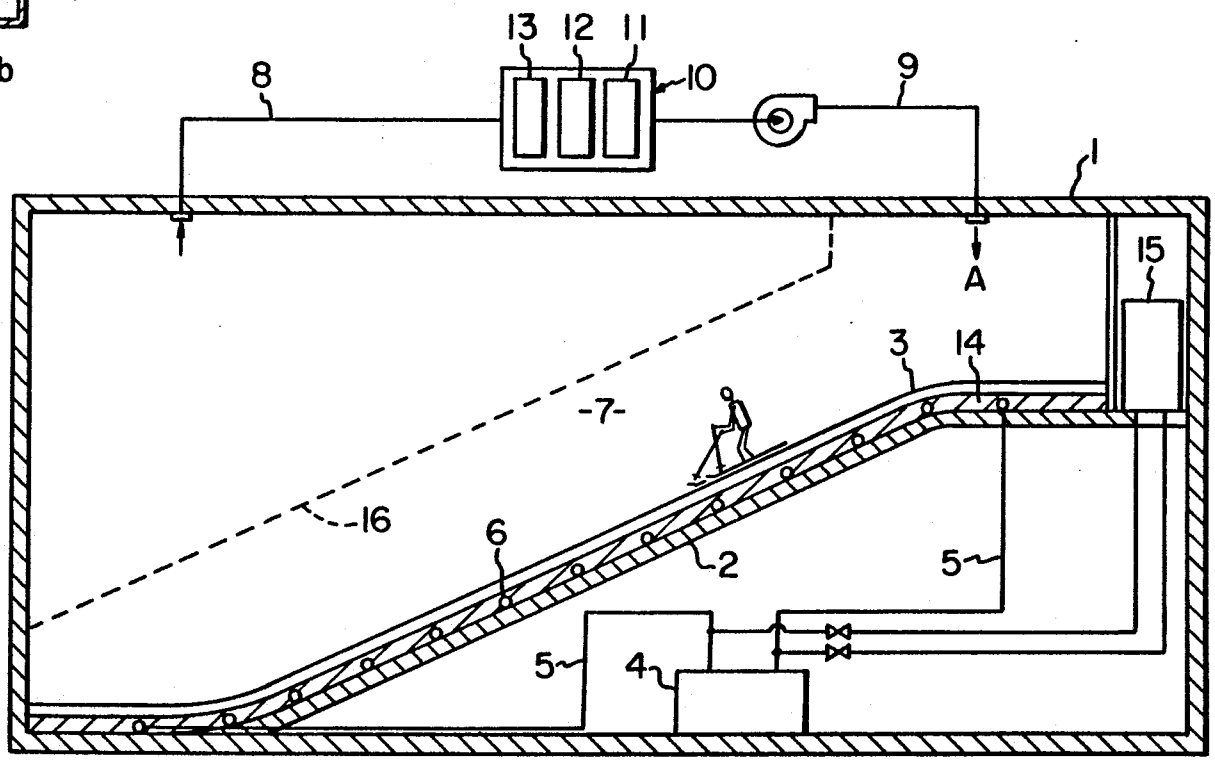
FIG. 3 is a view showing a construction of an indoor artificial snow skiing slope relating to a further embodiment of the present invention.

In the foregoing embodiment, the accumulated frost layer 3 is directly formed on the side of the floor 2. An alternative method is possible as illustrated in FIG. 3. That is, prior to the formation of the accumulated frost layer 3 as an artificial snow layer, an ice layer 14 is formed on the floor 2. Then, the additional water content or the water mist added to the atmosphere above the floor 2 is frost-frozen by the refrigerating function of the refrigerating-medium means 6 incorporated at the floor 2 so that the accumulated frost layer 3 as the artificial snow layer will be formed on the ice layer 14.

For the formation of the ice layer 14, as illustrated also in FIG. 3, fine ice particles prepared by an ice making machine 15 are sprayed over the floor 2 and then the sprayed ice particles are added with water supplied by sprinkling, so that the added water is frozen by the refrigerating means 6 of the floor 2. In this way, the ice layer 14 is formed on the floor 2 prior to the formation of the accumulated frost layer 3 as an artificial snow layer. This method is more efficient than the foregoing method.

For adding the additional water content to the atmosphere above the floor 2 by means of the humidifier and for supplying the water mist to the atmosphere above the floor 2, it is conceivable to limit the atmosphere above the floor 2 by covering the area above the floor 2 by means of a cover 16 as denoted by a broken line in FIG. 3, so that the addition of the additional water content or the water mist is effected only to the limited atmosphere. In particularly, this method using the cover 16 will prove very effective in case the atmosphere above the floor 2 comprises a large open atmosphere. Incidentally, after the formation of the accumulated frost layer 3 as the artificial snow layer, the cover 16 is removed, so that this cover 16 will not interfere with use of the artificial snow layer.

In the foregoing embodiment, at the development stage of the accumulated frost layer 3, a compression treatment or water impregnating treatment and subsequently freezing operation of the impregnated water content, i.e. the formation of partial ice layer from the accumulated frost layer 3*a* being developed is done. However, in embodying the method of the invention, these treatments can be eliminated.

After the formation of the accumulated frost layer 3 as an artificial snow layer, it is conceivable to effect a compression treatment or a raking treatment on the surface portion of the layer 3 order to condition the snow layer surface.

The use of the accumulated frost layer 3 as an artificial snow layer is not limited to skiing, but the layer can be used in various kinds of activities.

The floor 2 can be of any type, e.g. a horizontal flat floor, a sloped floor, an uneven floor, a floor of a narrow passage, etc.

Figure 4:
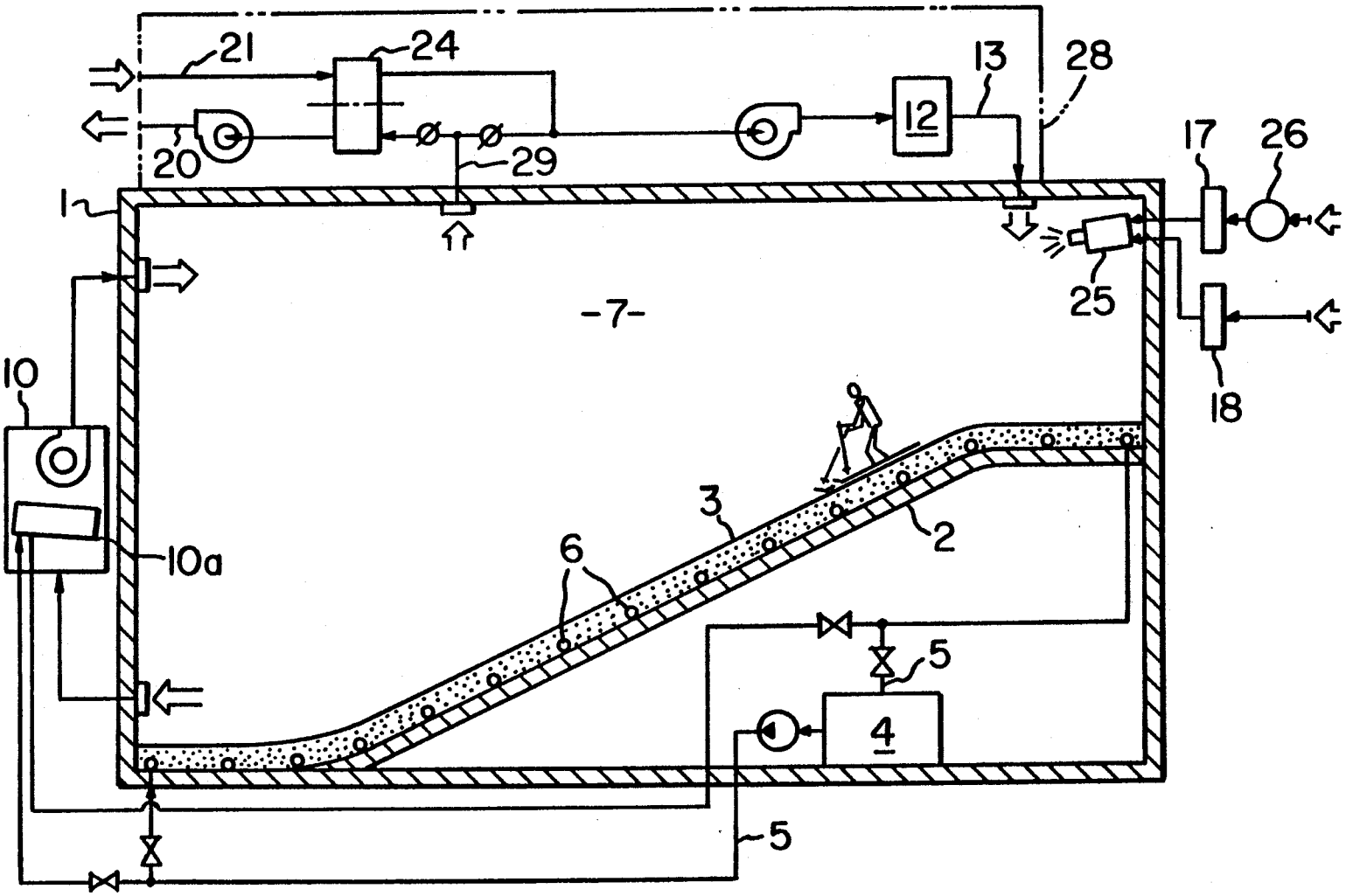
FIG. 4 is a view showing a construction of an indoor artificial snow skiing slope relating to a method of maintaining an artificial snow layer of the present invention.

Next, a method or maintaining the artificial snow layer will be particularly described. In FIG. 4, a numeral 28 denotes a unit for ventilation and humidity adjustment. In operation, a portion of indoor atmosphere introduced from an air intake passage 29 is exhausted through an air exhaust passage 20 to the outdoor and also the rest of the introduced atmosphere is mixed with fresh outdoor atmosphere introduced through an outdoor air passage 21. Then, the mixed atmosphere is dehumidified by the dehumidifier 12 and is recycled to the indoor space 7 through an air intake duct 13.

A numeral 24 denotes a total enthalpy heat exchanger, which operates to collect cold heat retained in the atmosphere to be exhausted into the outdoor and to preliminarily cool newly introduced fresh outdoor atmosphere by means of the collected cold heat.

A numeral 25 denotes a snow gun for making artificial snow. In operation, atmosphere compressed by a compressor 26 and cooled by a cooling device 17 and cold water cooled by a further cooling device 18 are supplied to the snow gun 25, so that the snow gun 25 sprays the cold water into the indoor space 7 together with the compressed low-temperature atmosphere.

For forming the artificial snow layer 3 on the floor 2, the refrigerating medium (e.g. brine at −20 degrees in Celsius) is fed by the refrigerating device 4 to be circulated to the refrigerating coil 10*a* of the air-conditioning device 10, so that the air-conditioning device 10 cools the indoor atmosphere down to a predetermined temperature Tc below the freezing point (e.g. −5 degrees in Celsius).

Then, while the air-conditioning device 10 continuously cools the indoor atmosphere to maintain this at the predetermined temperature Tc below the freezing point, the cold water together with the compressed low-temperature air are sprayed by the snow gun 25 into the indoor atmosphere. So that, through the adiabatic expansion effect associated with the nozzle spraying and the refrigeration of the indoor air, the sprayed water is frozen into fine ice particles. Then, as the ice particles are accumulated on and spread over the floor, an artificial snow layer comprised of ice particles and having a predetermined thickness is formed on the floor stir face 2.

Incidentally, prior to the formation of the artificial snow layer 3, it is conceivable to form a frozen sand layer on the floor 2. For this, the sand will be spread over the Floor 2 and water will be added to this sand while the refrigerating device 4 feeds the refrigerating medium to the refrigerating-medium pipes 6 at the floor 2, so that the added water will be frozen. Alternately, without using such sand, the refrigerating device 4 will feed the refrigerating medium to the refrigerating-medium pipes 6 of the floor 2, so that water content contained in the indoor atmosphere will be frost-frozen by the refrigerating-medium pipes 6. And, this frost layer will be added with further water to be frozen also. These formations of the frozen sand layer and frozen frost layer will effectively protect the refrigerating-medium pipes 6.

Preferably, for decreasing the load on the air-conditioning device 10 thus achieving energy saving, the formation of the artificial snow layer 3 is done during night when introduction of outdoor heat is minimum.

For maintenance of the artificial snow layer 3 after the formation thereof, the amount of the refrigerating medium supplied to the air-conditioning device 10 will be reduced so as to release the maintenance of the indoor atmosphere at the temperature below the freezing point. Thereafter, the supply amount of the refrigerating medium to the air-conditioning device 10 will be fine-adjusted within the reduced range so as to maintain the indoor atmosphere at a predetermined temperature Tw higher than the freezing point (e.g. 7 through 10 degrees in Celsius ). With this, it is possible to prevent the skiers present indoors from feeling uncomfortably cold or a strong thermal shock during the entrance or exit to and from the indoor space.

While the indoor atmosphere is maintained at the predetermined temperature Tw higher than the freezing point, the refrigerating medium is supplied to the refrigerating-medium pipes 6 of the floor 2 and also the amount of the refrigerating medium supplied to the pipes 6 is so controlled as to maintain the surface temperature of the snow layer 3 at the predetermined snow surface temperature Ts lower than the freezing point. In this way, melting of the snow layer 3 is prevented by the refrigerating function of the refrigerating-medium pipes 6 incorporated at the floor 2.

Further, in addition to the prevention of melting of the snow layer 3 by means of the refrigerating function of the refrigerating-medium pipes 6, the dehumidifier 12 is operated, during which the dehumidifying amount of this dehumidifier 12 is so controlled as to maintain a dew-point temperature of the indoor atmosphere at a value substantially equal to the surface temperature Ts of the snow layer 3, i.e. to maintain the water vapor pressure of the indoor atmosphere at a value substantially equal to the water vapor pressure of the surface of the snow layer 3. This can prevent transfer of water content from the indoor atmosphere to the snow layer 3. More particularly, the above can prevent the transfer of additional water content added to the indoor atmosphere through the breaths of the users present indoors and/or introduction of fresh outdoor atmosphere to the snow layer 3 thus preventing such additional water content from being coagulated on the surface of the snow layer 3. Consequently, this arrangement can prevent the snow surface from becoming sticky due to the coagulation and also prevent disadvantageous increase in the load on the refrigerating-medium pipes 6. Reversely, the arrangement can also prevent transfer of water content from the snow layer 3 to the indoor atmosphere thereby to prevent decrease in the thickness of the snow layer due to vaporization of the water content of the snow into the atmosphere.

In the foregoing embodiment, the entire snow layer 3 is comprised simply of an accumulated layer of fine ice particles. Instead, an alternative arrangement is possible. That is, a lower layer portion of the snow layer 3 (e.g. the lower layer portion having 10 to 12 cm relative to the entire snow layer 3 having a thickness ranging about 15 cm) is added with additional water content, so that this additional water content is frozen by the refrigerating-medium pipes 6 so as to render this layer portion a frozen layer portion. With this alternative arrangement, the upper layer portion of the snow layer 3 will be maintained as the layer comprised of fine ice particles which nature is similar to that of natural snow. Whereas, the lower layer portion of the snow layer 3 is formed as the frozen layer portion which has good heat transmission efficiency between the pipes 6 and the snow layer 3. Accordingly, it becomes possible to reduce the load on the refrigerating-medium pipes 6 during the maintenance of the snow layer 3 and consequently, required energy can be significantly reduced.

In case the surface of the snow layer becomes hardened by skiing actions, the hardened surface will be crushed by means of an appropriate crushing device so as to restore the original condition of the snow layer surface. In this respect, since this crushing operation is effected on the upper layer portion comprised of fine ice particles, the required force will be significantly smaller than a case where an ice layer is to be crushed.

In case the thickness of the snow layer 3 decreases due to scraping of the layer by skiers or by elimination of soiled snow portion, like the process of the initial formation of the snow layer, the indoor atmosphere is cooled to the predetermined temperature Tc lower than the freezing point by means of the air-conditioning device 10 and in this condition fine ice particles are sprayed by the snow gun 25 to be accumulated on the remaining snow layer 3. In this way, the formation of additional snow layer can be done in an efficient manner. Thereafter, the maintenance of the indoor atmosphere at the temperature below the freezing point is released and the process is immediately shifted to the snow layer maintaining condition utilizing the snow layer refrigerating operation by the pipes 6 of the floor 2 and the humidity adjustment operation by the dehumidifier 12.

In the formation of the snow layer, the air-conditioning device 10 for cooling the indoor atmosphere above the floor 2 at the temperature below the freezing point can be of any other types. Similarly, the spraying means for spraying the water into the cooled atmosphere to produce ice particles can be of any other conventional types.

In the foregoing embodiment, as the snow layer refrigerating means, there are employed a plurality of refrigerating-medium pipes 6 disposed side by side. Instead, other constructions and types can be used, such as a plurality of refrigerating panels, or a construction using double floor structure in which the refrigerating medium is caused to pass at the gap between the two floors.

In the foregoing embodiment, for the maintenance of the snow layer 3, the indoor atmosphere is dehumidified by the dehumidifier 12 so as to render the dew-point temperature of the indoor atmosphere substantially equal to the surface temperature of the snow layer 3, so as to prevent the water content in the atmosphere from being coagulated on the snow layer surface as well as to prevent scattering of the water content of the snow layer 3 into the indoor atmosphere. Instead, it is also conceivable to prevent only the coagulation of the water content of the indoor atmosphere on the surface of the snow layer 3 through the humidity adjustment of the indoor atmosphere by the means of the humidity adjusting means.

As the above-described humidity adjustment means 12 for dehumidifying the indoor atmosphere to prevent coagulation of the water content therein on the surface of the snow layer 3, various other types of constructions can be employed.

The actual use of the artificial snow layer 3 formed and maintained by the method of the present invention is not limited to the use for skiing, but the snow layer can be used for other sporting activities such as bobsledding or other purposes, e.g. snow play for children or enjoyment of snow sight, etc.

Further, the area above the floor is not limited to the indoor space, but may be an open outdoor space.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of claims are therefore intended to be embraced therein.

What is claimed is:

1. A method of maintaining an artificial snow layer in an indoor atmosphere, said method comprising the steps of:

(a) maintaining a temperature of said indoor atmosphere above a floor surface below a freezing point of water by an atmosphere refrigerating means;

(b) forming said artificial snow layer by spraying water into said indoor atmosphere and causing said water to freeze and accumulate as ice particles on said floor surface;

(c) after step (b), reducing the work of said atmosphere refrigerating means to no longer maintain the temperature of the indoor atmosphere below the freezing point of water;

(d) operating a floor refrigerating means incorporated at said floor surface to prevent melting of the formed artificial snow layer; and (e) controlling the humidity of said indoor atmosphere by adjusting a humidity adjusting means to maintain the water vapor pressure of said indoor atmosphere at a value substantially equal to the water vapor pressure at a surface of said artificial snow layer and to prevent water in said indoor atmosphere from coagulating on said surface of said artificial snow layer.

2. The method according to claim 1, wherein the indoor atmosphere above the floor surface is maintained below the freezing point of water during step (a) by circulating a refrigerating medium to a refrigerating coil of said atmosphere refrigerating means by means of a cooling device.

3. The method according to claim 1, wherein said humidity adjusting means includes a dehumidifier.

* * * * *